US005796030A

United States Patent [19]

Olofsson

[11] Patent Number: 5,796,030

[45] Date of Patent: Aug. 18, 1998

[54] MINE

[75] Inventor: Göran Olofsson, Eskilstuna, Sweden

[73] Assignee: Bofors AB, Karlskoga, Sweden

[21] Appl. No.: 716,251

[22] PCT Filed: Mar. 10, 1995

[86] PCT No.: PCT/SE95/00247

§ 371 Date: Sep. 13, 1996

§ 102(e) Date: Sep. 13, 1996

[87] PCT Pub. No.: WO95/25938

PCT Pub. Date: Sep. 28, 1995

[30] Foreign Application Priority Data

Mar. 22, 1994 [SE] Sweden ..... 9400941

[51] Int. Cl.[6] ..... F42B 23/00

[52] U.S. Cl. ..... 102/424; 102/401; 102/428

[58] Field of Search ..... 102/306–310, 102/401, 424, 428, 429, 476

[56] References Cited

U.S. PATENT DOCUMENTS 3,216,354 11/1965 Bearce ..... 102/428
3,399,620 9/1968 Pecksen et al. ..... 102/428
3,411,445 11/1968 Madlener et al. ..... 102/429
3,521,563 7/1970 Bekcer ..... 102/428
4,252,062 2/1981 Auge .

FOREIGN PATENT DOCUMENTS 0 157 902 10/1985 European Pat. Off. .
31 12 388 7/1986 Germany .

*Primary Examiner*—Harold J. Tudor
*Attorney, Agent, or Firm*—Pollock, Vande Sande & Priddy

[57] ABSTRACT

A mine has a casing which encloses an explosive and a primary charge arranged in the center of the explosive near the bottom of the mine. A liner is connected over the explosive in order to delimit the explosive to generate the shape charge effect and a spacing member is arranged between the primary charge and the liner. The spacing member has an upper portion which defines an opening and a lower portion which faces the bottom of the mine. The lower portion of the spacing member is shaped substantially as a circumference of a frustrum of a cone, with a base facing towards the bottom of the mine. A triggering arrangement, having a fuze and a trigger is supported by a holder. The holder is located above the opening in the spacing member. The trigger extends from an upper side of the mine through the opening to act on the primary charge.

9 Claims, 4 Drawing Sheets

MINE

FIELD OF THE INVENTION

The present invention relates to a mine which comprises a triggering arrangement provided with a trigger and fuze, a primary charge, explosive and impact body in the form of a liner for generating the shaped charge effect. The fuze initiates the explosive via the primary charge.

BACKGROUND OF THE INVENTION

There is a general need to increase the impact of mines which function in accordance with the shaped charge principle. The mine should not just provide impact upon striking against the track of the tank, but also upon striking the belly of the tank, a so-called full-width attack. The liner should in this case assume the form of a projectile which penetrates the belly of the tank at great speed. Secondary splinters generated at the belly of the tank are hurled into the vehicle and cause great damage to parts which are vital to the functioning of the tank.

In known mines operating in accordance with the shaped charge principle, the initiation takes place centrally in the explosive with the aid of a large primer.

SUMMARY OF THE INVENTION

The object of the present invention is to produce a mine which provides increased impact, for example in the form of greater penetration through armour plate, compared with present-day mines.

The object of the invention is achieved by a mine which is characterized in that the primary charge is placed in close proximity to the bottom of the mine, and a spacing member is arranged between the primary charge and the liner. By lowering the point of initiation, the energy of the explosive is better utilized upon transfer to the liner. This is due, on the one hand, to the greater angle of incidence with respect to the liner and, on the other hand, to the fact that the detonation distance is extended and thereby the detonation velocity increased. Trial explosions and calculations have confirmed the increased impact from the explosive.

The spacing member can be of solid design or can have air gaps. Appropriate damping can be achieved by the possibilities of varying the design of the spacing member.

In a preferred embodiment, that part of the spacing member facing towards the bottom of the mine has a shape which is essentially of the circumferential surface of the frustum of a cone, with the base facing towards the bottom of the mine. This shape contributes to further lowering of the point of initiation.

The spacing member can be a separate unit, but it can also advantageously be made integral with the holder for the triggering arrangement, as a result of which coupling arrangements in the form of screw connections or the like can be simplified, and the number of components included can be minimized.

In a further preferred embodiment, the triggering arrangement is arranged to act on the top side of the primary charge. In this way, the triggering arrangement can be placed at a higher position nearer to the top of the mine, and at the same time the primary charge is concentrated at the bottom.

According to another alternative embodiment, the fuze of the triggering arrangement is arranged to act on the primary charge from a hole which is disposed at the center of the primary charge. This arrangement ensures effective and symmetrical initiation of the primary charge and provides for an optimal angle of incidence with respect to the explosive and, consequently, maximum impact.

The invention will be described in greater detail below by way of example, with reference to the attached drawings, in which:

DETAILED DESCRIPTION OF THE PREFERRED EMBODIMENTS

Figure 1:
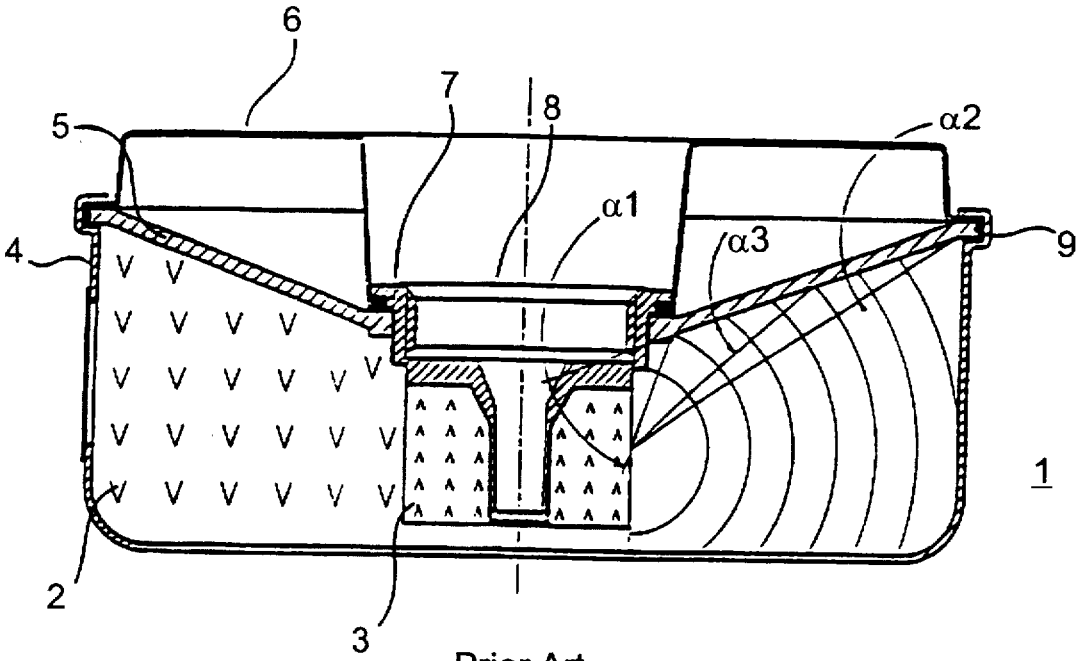
Prior Art Fig. 1
FIG. 1 shows an example of a known mine design.

The mine designs shown in FIGS. 1 to 5 comprise an explosive 2 and a primary charge 3 accommodated in a casing 4. The top side of the explosive is delimited by an impact body in the form of a liner 5. A cover 6 over the liner 5 forms, together with the casing 4, the outer limit of the mine. The purpose of the cover 6 is to keep the projectile-forming zone of the mine free from contamination, so that the shaped charge can develop undisturbed. In the center of the mine 1 there is a holder 7 for the mine triggering arrangement, with trigger and fuze. The fuze includes a detonator. The trigger and fuze are of any known type and are therefore not described further. The fuze is intended to act on the primary charge 3. The triggering arrangement can be introduced through an opening 8 in the cover 6. At the junction between casing 4 and cover 6, at the point where the liner 5 also joins, there are sealing means 9 in the form of a sealing compound, sealing ring or the like. The sealing between cover 6 and holder 7 can be obtained in a similar way.

The known design shown in FIG. 1 is provided with a large primary charge 3 which is placed centrally in the explosive 2 and which is used to initiate the explosive. On the right-hand side of the Figure, the angle of incidence with respect to the liner has been shown for three cases, namely for impact on the centermost part of the liner $\alpha_1$, impact on the most peripheral part of the liner $\alpha_2$, and impact on the liner at an intermediate point $\alpha_3$. The angles of incidence can have the following values: $\alpha_1 \approx 49°$, $\alpha_2 \approx 14°$ and $\alpha_3 \approx 22°$.

Figure 2:
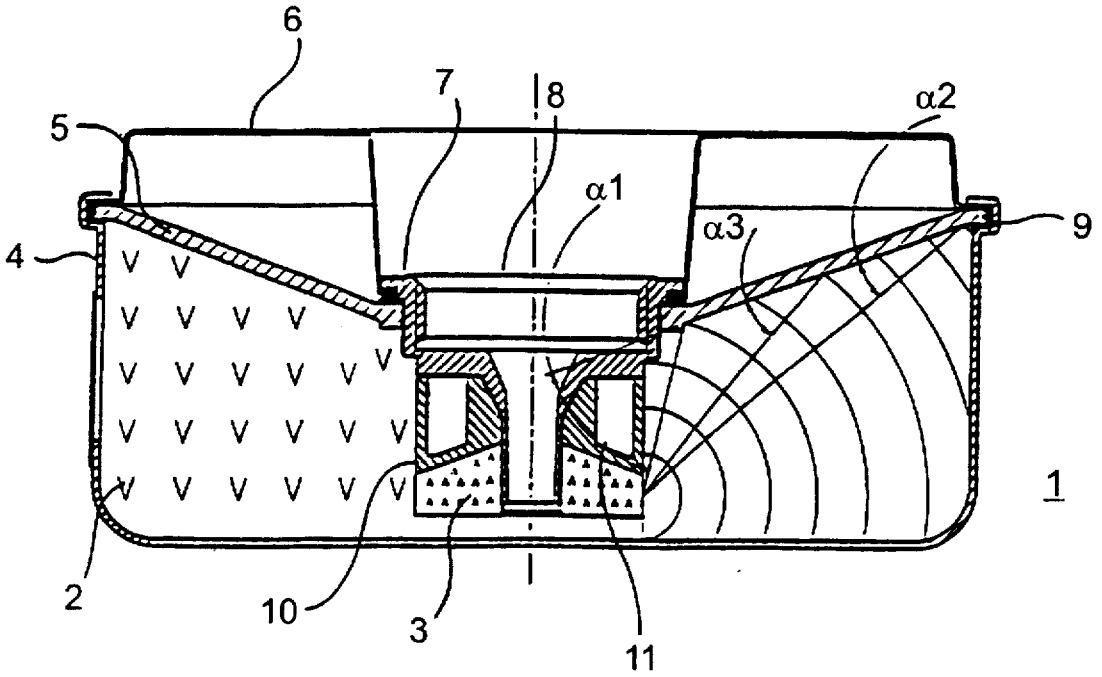
FIG. 2 shows a first example of a mine design according to the invention, with a low point of initiation.
Figure 6:
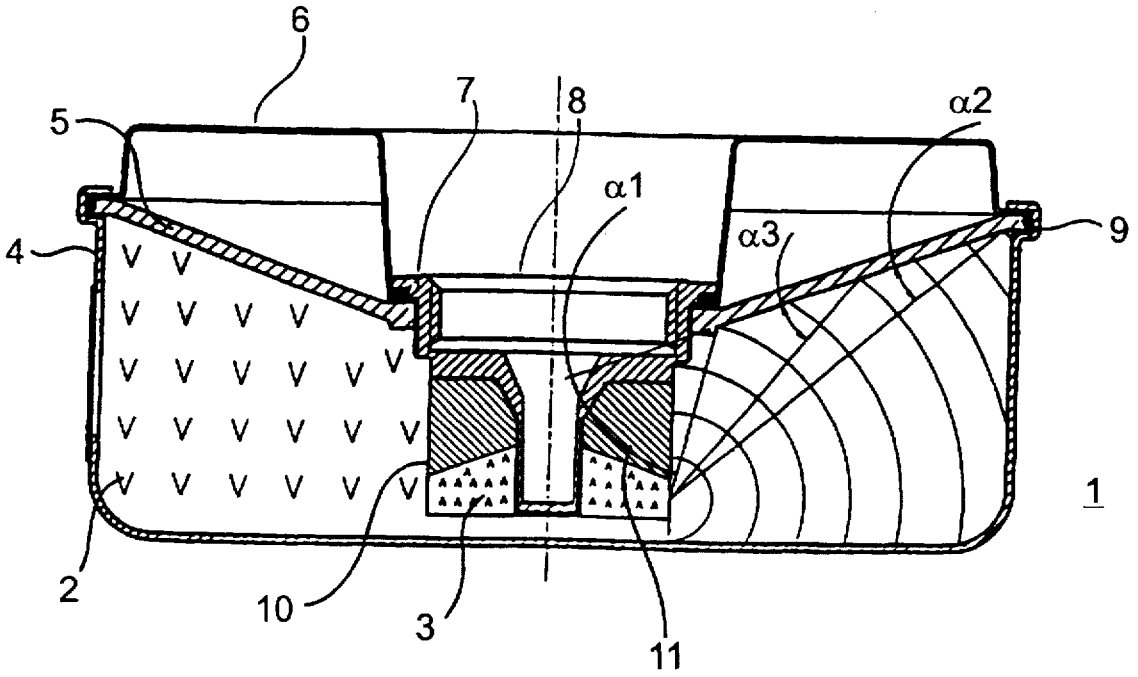
FIG. 6 shows a fifth example of a mine design according to the invention, with a solid spacer.

FIG. 2 shows a first mine design with a low point of initiation. A spacing member 10 is in this case introduced between the holder 7, for the triggering arrangement of the mine, and the primary charge 3. The spacing member shown is designed with an air gap 11 which affords good damping. Alternatively, the spacing member can be made of solid material as shown in FIG 6. Angles of incidence corresponding to those in the case of the known design, as described with reference to FIG. 1, have been inserted on the right-hand side of the Figure. The angles of incidence can have the following values: $\alpha_1 \approx 56°$, $\alpha_2 \approx 21°$ and $\alpha_3 \approx 31°$.

By comparing the angles of incidence, and the distances between the primary charge and liner, in the known design and in the design according to the invention, with its low point of initiation, it will be is observed that the design according to the invention provides for greater angles and longer distances. A longer distance between primary charge and liner results in a higher detonation velocity being achieved. By means of the arrangement according to the invention, it is possible to achieve, on the basis of the above observation, a better utilization of the energy of the explosive and, finally, a more effective impact against a tank.

Figure 3:
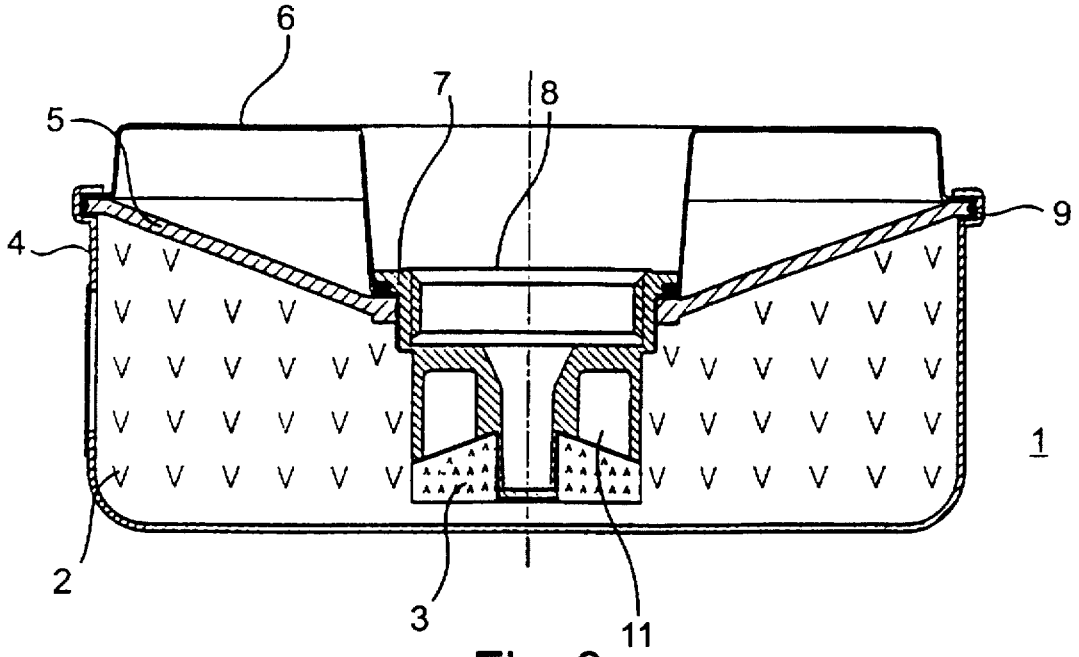
FIG. 3 shows a second example of a mine design according to the invention, with a low point of initiation.

FIG. 3 shows a second example of a design according to the invention. In this case, the spacing member is made integral with the holder 7 for the triggering arrangement.

Figure 4:
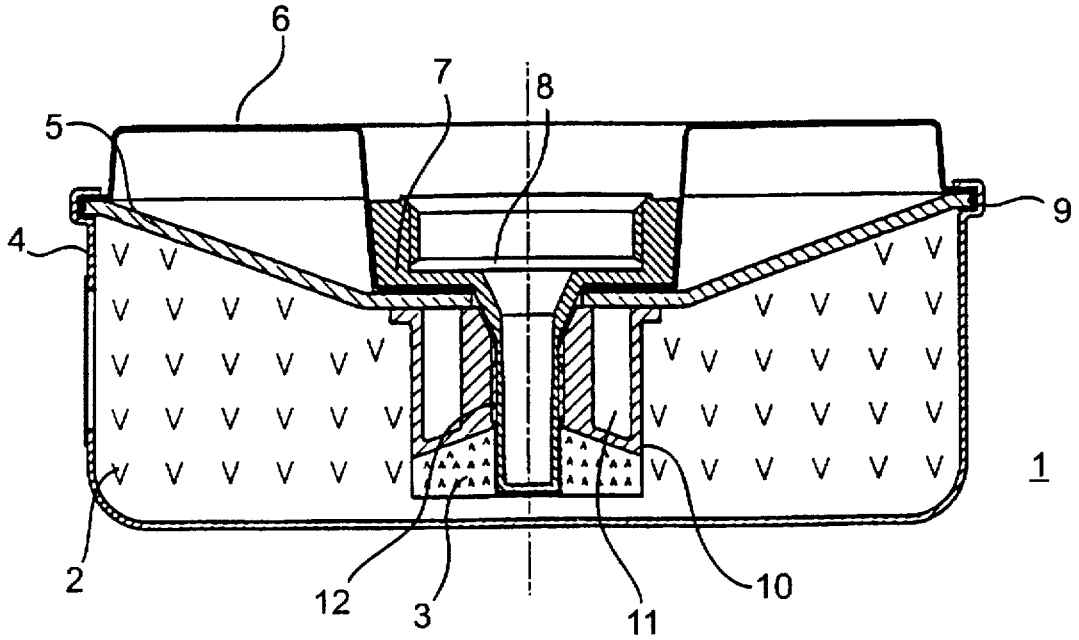
FIG. 4 shows a third example of a mine design according to the invention, with a low point of initiation.

Mine 1 according to the invention with a separate spacing member 10 is shown in FIG. 4. The spacing member 10 is coupled to the holder 7 by means of a screw connection 12.

Figure 5:
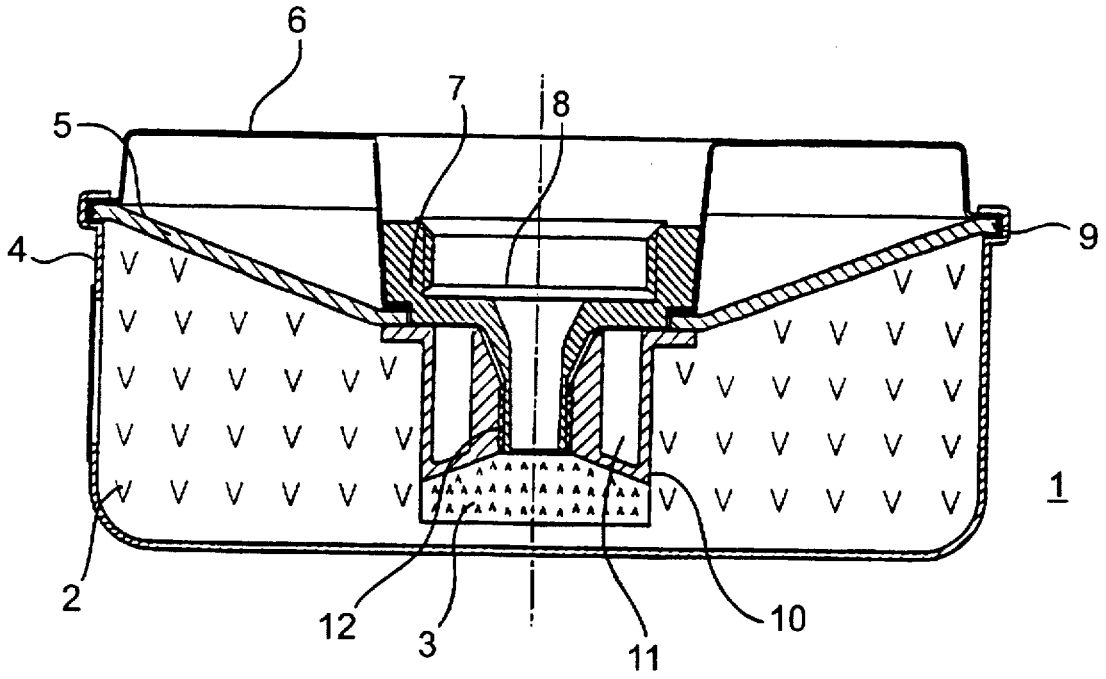
FIG. 5 shows a fourth example of a mine design according to the invention, with a low point of initiation, and has been inserted.

FIG. 5 shows a further example of a design with a separate spacing member 10 which has been coupled to the holder 7 by means of a screw connection 12. The primary charge 3 in this case differs from the previously shown designs in that it is without a central hole for the holder 7. The fuze of the triggering arrangement can in this case act on the top side of the central part of the primary charge.

We claim:

1. A mine comprising:

a casing;

an explosive secured inside said casing;

a primary charge arranged in said explosive and located close to a bottom of said mine;

a liner positioned over said explosive and delimiting said explosive for generating the shape charge effect;

a spacing member arranged between said primary charge and said liner, said spacing member having an upper portion defining an opening and a bottom portion opposite said upper portion and facing said bottom of said mine, said bottom portion being shaped substantially as a circumferential surface of a frustum of a cone, with a base facing towards said bottom of said mine, said primary charge having a frustum upper surface mating with said circumferential surface; and a triggering arrangement, having a trigger and a fuze, supported by a holder, said holder being located above said opening in said spacing member whereby said trigger extends from an upper side of said mine through said opening and communicates with said primary charge.

2. The mine according to claim 1 wherein said primary charge defines a hole in its center on a side facing said spacing member, said trigger acting on said primary charge via said hole.

3. The mine according to claim 1 wherein said spacing member defines an air gap therein.

4. The mine according to claim 1 wherein said spacing member is a separate unit.

5. The mine according to claim 1 wherein said spacing member is integral with said holder.

6. The mine according to claim 1 wherein a portion of said spacing member which abuts said explosive is shaped similar to an envelope surface of a cylinder.

7. The mine according to claim 1 wherein the trigger of the trigger arrangement is disposed to act on a top side of the primary charge.

8. The mine according to claim 1, wherein the spacing member is solid.

9. The mine according to claim 4, wherein the spacing member is coupled to the holder for the triggering arrangement by means of a screw connection.

* * * * *